US006198209B1

(12) United States Patent
Baldwin et al.

(10) Patent No.: US 6,198,209 B1
(45) Date of Patent: Mar. 6, 2001

(54) SHIELDED SPARK PLUG ELECTRODE

(75) Inventors: Darryl D. Baldwin, Lacon, IL (US); David W. Brandes, Lafayette, IN (US); Richard P. Staab, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/161,349

(22) Filed: Sep. 25, 1998

Related U.S. Application Data

(60) Provisional application No. 60/068,436, filed on Dec. 22, 1997.

(51) Int. Cl.[7] ..... H01T 13/20

(52) U.S. Cl. ..... 313/141; 313/143; 313/118

(58) Field of Search ..... 313/140, 141, 313/143, 134, 118; 445/7

(56) References Cited

U.S. PATENT DOCUMENTS

| | | | | |
|---|---|---|---|---|
| 1,468,539 | | 9/1923 | McCune et al. . | |
| 2,642,054 | | 6/1953 | Wright | 123/169 |
| 2,674,237 | | 4/1954 | Peters | 123/169 |
| 3,292,606 | * | 12/1966 | Ervin | 313/141 |
| 3,896,322 | | 7/1975 | Sawada et al. | 313/142 |
| 3,921,605 | | 11/1975 | Wyczalek | 123/143 B |
| 4,041,922 | | 8/1977 | Abe et al. | 123/191 S |
| 4,182,281 | | 1/1980 | Heintzelman | 123/30 D |
| 4,305,357 | | 12/1981 | Scherenberg et al. | 123/254 |
| 4,354,136 | | 10/1982 | Hamai et al. | 313/139 |
| 4,490,122 | * | 12/1984 | Tromeur | 313/141 |
| 4,499,399 | | 2/1985 | Flores | 313/143 |
| 4,808,878 | | 2/1989 | Kashiwara et al. | 313/141 |
| 4,987,868 | | 1/1991 | Richardson | 123/260 |
| 5,014,656 | | 5/1991 | Leptich et al. | 123/169 EL |
| 5,051,651 | | 9/1991 | Kashiwara et al. | 313/139 |
| 5,091,672 | | 2/1992 | Below | 313/143 |
| 5,554,908 | | 9/1996 | Kuhnert et al. | 313/140 |
| 5,623,179 | | 4/1997 | Buhl | 313/141 |

* cited by examiner

*Primary Examiner*—Michael H. Day
*Assistant Examiner*—Joseph Williams
(74) *Attorney, Agent, or Firm*—Alan J. Hickman

(57) ABSTRACT

A spark plug assembly for an internal combustion engine has a housing, an electrode, an axis and a conducting member radially oriented relative to the axis has a collar disposed about the axis and connected to an end of the housing. The spark plug is connected to the engine and exposed to a combustion chamber of the engine. The collar extends a predetermined distance from the end of the housing and shields a gap between the conducting member and electrode from air swirl introduced into a combustion chamber.

11 Claims, 1 Drawing Sheet

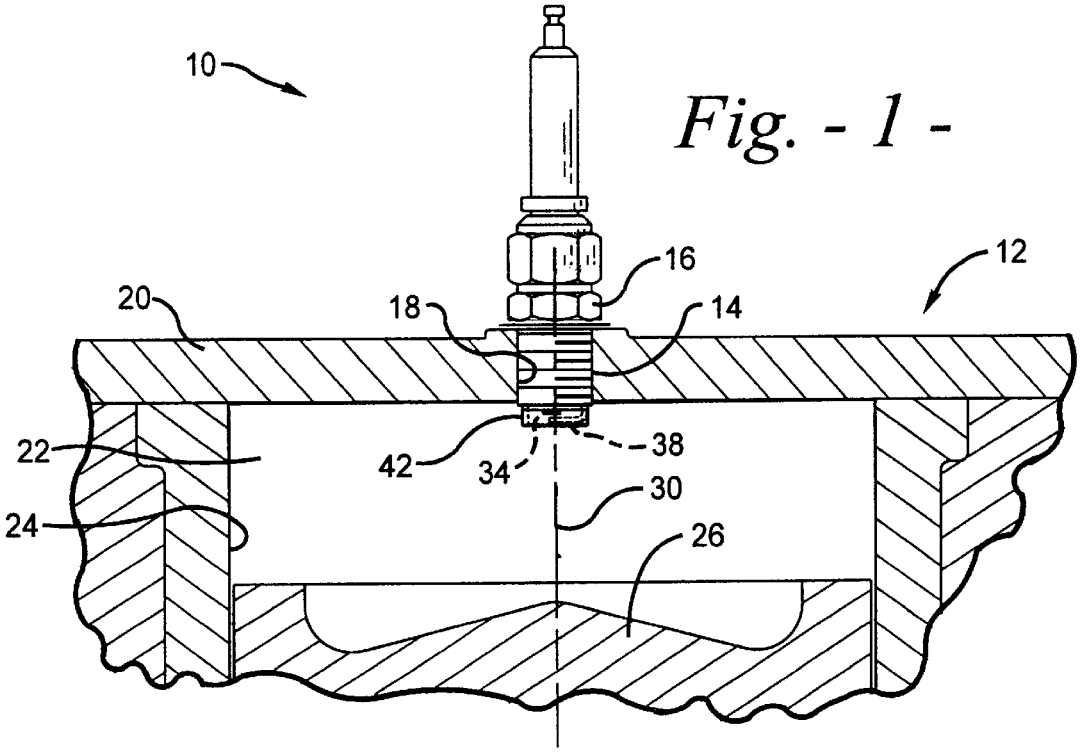
Fig. - 1 -
Fig. - 3 -
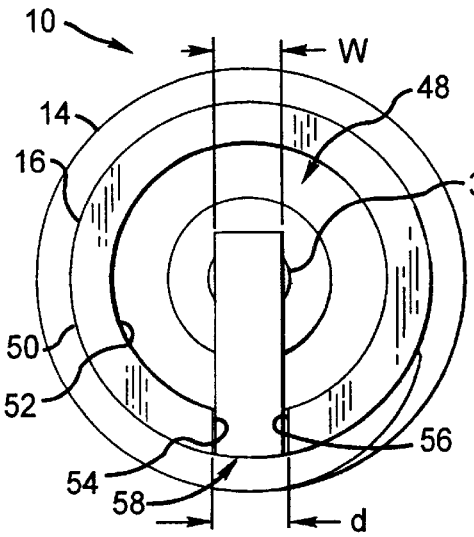
Fig. - 2 -
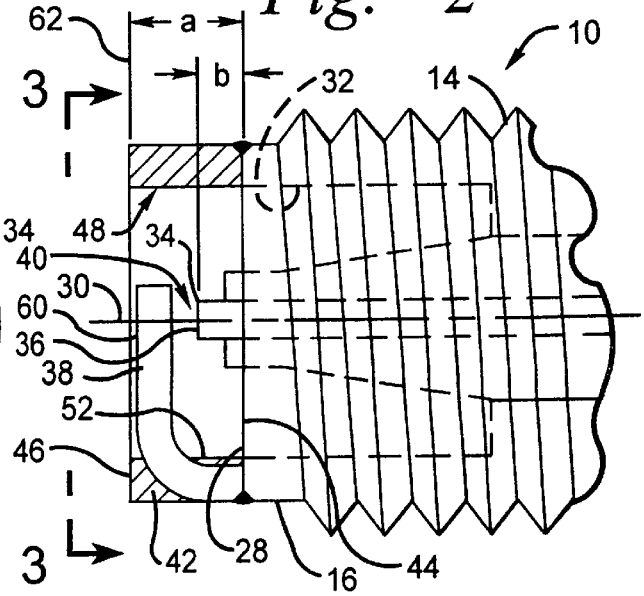

SHIELDED SPARK PLUG ELECTRODE

CROSS REFERENCE TO RELATED APPLICATIONS

This application claims the benefit of prior provisional patent application serial No. 60/068436 filed Dec. 22, 1997.

TECHNICAL FIELD

This invention relates to a spark plug and more particularly to a collar shielding a gap between an electrode and conductor of the spark plug.

BACKGROUND ART

Spark plugs used to ignite gaseous fuel in the combustion chambers of internal combustion engines typically have a gap between the electrode and conductor at one end portion of the spark plug. Such spark plugs are often referred to as "J-gap" type spark plugs. In rich gaseous fuel environments, these spark plugs have proven to be adequate to cause ignition of the fuel and satisfactory engine operation.

Tighter government emission regulations have prompted changes in internal combustion engine designs and operating parameters. In gaseous fueled engines, cleaner burning has been achieved by running the engine on leaner air to gaseous fuel ratio mixtures. Cleaner burning of leaner air to gaseous fuel mixtures after initial combustion has been further enhanced by adding swirl to the combustion chambers inlet air charge. This Swirl, however, induces turbulence near the gap of the "J-gap" spark plug and inhibits initial ignition of the gaseous fuel to air ratio mixture.

It has been known to provide an adapter for a "J-gap " spark plug. An example of such a spark plug is shown in U.S. Pat. No. 4,182,281, to Leo A. Heintzelman, dated Jan. 8, 1980. The adapter is screw threadably connected to the threaded end portion of the spark plug and encloses the open end portion of the spark plug. Such adapters tend to be expensive to manufacture and do not adequately provide the desired ignition characteristics.

The present invention is directed to overcoming one or more of the problems as set forth above.

DISCLOSURE OF THE INVENTION

In one aspect of the present invention, a shielded spark plug assembly is provided. The spark plug assembly has a housing. The housing has an end, an axis, and a bore opening at the end. An electrode having an end is disposed in the bore. The electrode extends axially relative to the bore. The end of the electrode is located a predetermined axial distance "b" from the housing end. A conducting member is connected to the end of the housing and extends radially relative to the bore of the housing to a location adjacent to and spaced a predetermined gap distance from the electrode end. A collar has first and second spaced apart ends and a bore opening at the first and second ends of said collar. The collar first end is connected to the end of the housing and the collar second end is located a predetermined axial distance "a" spaced from the housing end. The conducting member is located between the end of the housing and the second end of the collar. The collar shields the electrode and the conducting member.

BRIEF DESCRIPTION OF THE DRAWINGS

FIG. 1 is a diagrammatic embodiment of the present invention showing a cross-section of a portion of an internal combustion engine with a shielded spark plug connected to the engine and open to a combustion chamber of the engine;

FIG. 2 is a diagrammatic enlarged detail of a portion of the shielded spark plug; and FIG. 3 is a diagrammatic end view taken along lines 3—3 of FIG. 2 showing the shielded spark plug in greater detail.

BEST MODE FOR CARRYING OUT THE INVENTION

With reference to the drawings, and particularly FIG. 1, a shielded spark plug assembly 10 is shown screwthreadably connected to an internal combustion gas engine 12. A threaded end portion 14 of a housing 16 of the spark plug assembly 10 is threadably disposed in a threaded bore 18 in a cylinder head 20 of the internal combustion engine 12. The threaded end portion 14 of the spark plug assembly 10 extends into a combustion chamber 22, located within the cylinder liner 24 of the engine 12, to a location between a reciprocally movable piston 26 and the cylinder head 20. The cylinder head 20 has intake and exhaust valves (not shown) for controlling intake air and exhaust gas flow between the combustion chamber 20 and intake and exhaust manifolds in a conventional manner. Fuel and air is mixed up-stream of a turbocharger of the engine and introduced to the combustion chamber by the intake valves. Internal combustion engines of this type 12 are well known by those skilled in the art and will therefore not be discussed in any greater detail.

As best seen in FIGS. 2 and 3, the housing 16 of the shielded spark plug assembly 10 has an end 28, an axis 30 extending longitudinally relative to the housing 16 and normal to the end 28, and a bore 32 opening at said end 28. The bore 32 is concentric about the axis 30. An electrode 34 extends along the axis 30 and from the bore 32 of the housing 16. The electrode 34 has an end 36 located a predetermined axial distance "b" from the housing end 28. The electrode 34 is insulated from the electrically conductive housing 16 and is of a suitable material for passing electrical energy from a source to a conducting member 38.

The conducting member 38 is connected to the end 28 of the housing 16 and extends radially relative to the axis 30 and bore 32 to a location adjacent to and spaced a predetermined axial distance from the electrode end 36. This distance defines a gap 40 between the electrode 36 and the conducting member 38. The predetermined axial gap distance is established by engine 12 operating parameters. The conducting member 38 conducts electrical energy passed between the electrode 34 and the housing 16. A spark is formed when the electrical energy jumps the gap 40.

A collar 42 has first and second spaced apart ends 44,46 and a bore 48 disposed in and opening at the first and second ends 44,46. The collar 42 is preferably tubular and has a cylindrical outside surface 50 and a cylindrical inside surface 52 defining the bore 48. The collar 42 has first and second spaced sides 54,56 defining a slot 58 therebetween. The slot 58 extends between the inside and outside surfaces and axially between the first and second collar ends 44,46. The first and second sides 54,46 are spaced a preselected distance "d" apart. The first end 44 of the collar 42 is connected to the end 28 of the housing 16. The collar 42 is preferably coaxially disposed about the axis 30. The collar is preferably made from any suitable steel material and connected to the steel housing 16 in any suitable fashion, for example, by welding or brazing.

The second end 46 of the collar 42 is located a preselected axial distance "a" spaced from the end 28 of the housing 16. The conducting member 38 is located between the end 28 of the housing 28 and the second end 46 of the collar 42. The predetermined distance "a" from the end 28 of the housing 16 to the second end 46 of the collar 42 is greater in magnitude than the predetermined distance "b" between the end 36 of the electrode 34 and the end 28 of the housing 16. In the embodiment of the invention built and tested, the predetermined distance "a" from the end 28 of the housing 16 to the second end 46 of the collar 42 is about twice the predetermined distance "b" between the end 36 the electrode 34 and the end 28 of the housing 16. This relationship provides the desired amount of shielding of the electrode 38 and conducting member 38 during operation of the engine 12.

The conducting member 38 has an outer end surface 60. The outer end surface 60 is substantially flush with a plane 62 defined by the second end 46 of the collar 42. The conducting member 38 has a predetermined width "w". The predetermined distance "d" between the first and second sides 54,56 is equal to or a predetermined magnitude greater than the predetermined width "w" of the conducting member 38. The first and second sides 54,56 defining the slot 58 straddle the conducting member 38. The clearance between the conducting member 38 and the sides 54,56 is kept to a minimum to facilitate assembly and prevent excessive air swirl from passing through the slot 58 and affecting combustion of the gaseous fuel within the bore 48 of the collar 42.

INDUSTRIAL APPLICABILITY

With reference to the drawings, and in operation, the shielded spark plug assembly 10, in response to receiving electrical energy, produces a spark at the gap 40 between the end 36 of the electrode 34 and the conducting member 38. The air and gaseous fuel mixture in the combustion chamber 22 adjacent the gap 40 is ignited in response to the spark at the gap 40. This ignition causes an expansion of the gasses in the combustion chamber and movement of the piston away from the cylinder head.

During an intake stroke of the piston 26 fuel and air are introduced into the combustion chamber 22 and subsequently compressed and ignited. The introduction of a lean air to fuel ratio mixture to the combustion chamber 22 increases the potential for a faulty ignition of the fuel and air mixture. Ignition of a lean fuel mixture is further aggravated when air swirl is introduced to the combustion chamber 22. The collar 42, shielding the gap 40 of the electrode 34 and conducting member 38, maintains a rich enough air to fuel ratio mixture at the gap 40 so that ignition may take place and misfiring is eliminated. By shielding the gap 40 from swirl, the potential for lower spark temperature and a too lean mixture are eliminated.

The dimensional relationship between the collar 42, the electrode 34, and conducting member 38, as previously discussed, maximizes ignition capabilities by shielding the gap 40 from the effects of swirl but enables a suitable ratio of the fuel to air mixture to enter the bore 48 of the collar 42 for consistent ignition purposes.

Other aspects, objects and advantages of this invention can be obtained from a study of the drawings, the disclosure and the appended claims.

What is claimed is:

1. A shielded spark plug assembly, comprising:

a housing having an end, an axis, and a bore opening axially at the end;

an electrode having an end and being disposed in the bore, said electrode extending axially relative to the bore and said electrode end being located a predetermined axial distance "b" from the housing end;

a conducting member connected to the end of the housing and extending radially relative to the bore of the housing to a location adjacent to and spaced a predetermined gap distance from the electrode end;

a collar having first and second spaced apart ends and a bore opening at the first and second ends of said collar, said collar first end being connected to the end of the housing and said collar second end being located a predetermined axial distance "a" spaced from the end of said housing, said conducting member being located between the end of the housing and the second end of the collar, said collar having an inside surface defining said bore, a cylindrical outside surface, and first and second spaced sides defining a slot therebetween, said slot extending between the inside and outside surfaces and axially between the first and second collar ends, said slot straddling the conducting member and said conducting member being located within the cylindrical outside surface, said conducting member having an axial extending portion substantially closing the slot, said collar shielding the electrode and conducting member located within the cylindrical outside surface and between the first and second ends.

2. A shielded spark plug assembly, as set forth in claim 1, wherein said collar being tubular.

3. A shielded spark plug assembly, as set forth in claim 1, wherein said predetermined distance "a" from the end of said housing to the second end of said collar being greater in magnitude than the predetermined distance "b" between the end of the electrode and the end of the housing.

4. A shielded spark plug assembly, as set forth in claim 3, wherein said predetermined distance "a" from the end of the housing to the second end of the collar being about twice the predetermined distance "b" between the end of the electrode and the end of the housing.

5. A shielded spark plug assembly, as set forth in claim 1, wherein said conducting member has an outer end surface, said outer end surface being substantially flush with a plane defined by the second end of the collar.

6. A shielded spark plug assembly, as set forth in claim 1, wherein said conducting member having a predetermined width "w" and said first and second sides being spaced a predetermined distance "d" apart, said distance "d" between the first and sides being greater in magnitude than the width "w" of the conducting member.

7. A shielded spark assembly, as set forth in claim 1, wherein said conducting member having a predetermined width "w" and said first and second sides being spaced a predetermined distance "d" apart, said distance "d" between the first and second sides being substantially equal in magnitude to the width "w" of the conducting member.

8. A shielded spark plug assembly, as set forth in claim 1, wherein said collar being made from a steel material.

9. A shielded spark plug assembly, as set forth in claim 8, wherein said collar being connected to said housing by welding.

10. A shielded spark plug assembly, as set forth in claim 8, wherein said collar being connected to said housing by brazing.

11. A shielded spark plug assembly, as set forth in claim 8, wherein said collar being coaxially disposed about the axis of said housing.

* * * * *